United States Patent [19]

Guelck

[11] Patent Number: 4,941,287

[45] Date of Patent: Jul. 17, 1990

[54] WINDOW HAVING PIVOTAL STEP

[76] Inventor: Volker Guelck, 114 Columbia Street West, Waterloo, Ontario, Canada, N2L 3K8

[21] Appl. No.: 309,134

[22] Filed: Feb. 13, 1989

Related U.S. Application Data

[63] Continuation-in-part of Ser. No. 184,592, Apr. 21, 1988, abandoned.

[51] Int. Cl.[5] ..... E05D 15/00

[52] U.S. Cl. ..... 49/455; 49/195; 160/90

[58] Field of Search ..... 49/454, 455, 453, 397, 49/195, 176; 160/90, 89, 91

[56] References Cited

U.S. PATENT DOCUMENTS

| | | | |
|---|---|---|---|
| 389,405 | 9/1888 | Overton | 49/455 |
| 763,287 | 6/1904 | Hoyer | 49/455 |
| 2,107,711 | 2/1938 | Prifti | 49/195 |
| 2,570,986 | 10/1951 | Riley | 49/455 X |
| 2,818,609 | 1/1958 | Nielsen | 49/455 X |
| 3,023,465 | 3/1962 | Sconzo | 160/90 X |
| 4,074,483 | 2/1978 | Vickstrom | 160/90 X |
| 4,187,643 | 2/1980 | Sconzo | 49/455 |
| 4,622,778 | 11/1986 | Simpson | 49/453 X |
| 4,747,742 | 5/1988 | Zehnder | 49/397 X |

*Primary Examiner*—Philip C. Kannan
*Attorney, Agent, or Firm*—Daryl W. Schnurr

[57] ABSTRACT

A window has an inner sash and outer sash that are removable from the frame. A pivotal step is located along an outer surface of the inner sash. For a double-hung window, there are two pivotal steps, one along each side of the outer surface of the inner sash. For a horizontal slider window, there is one pivotal step along a top of the outer surface of the inner sash. When the inner sash is tilted inward or removed from the frame, the pivotal step can be rotated inward to allow the outer sash to be tilted inward or removed. When the pivotal step is in an operating position in the window, it greatly reduces the air flow from an exterior of the window to an interior of the window around the sashes. With previous windows, there is no step immediately adjacent to an outer surface of the inner sash or, if there is such a step, the presence of the step makes the removal of the sashes cumbersome.

19 Claims, 7 Drawing Sheets

WINDOW HAVING PIVOTAL STEP

This is a continuation-in-part application of application Ser. No. 07/184,592 filed Apr. 21, 1988 now abandoned.

BACKGROUND OF THE INVENTION

1. Field of the Invention

This invention relates to a window having an inner sash and an outer sash that are removable from a frame with a movable step located along one length of an outer surface of the inner sash. In particular, this invention relates to a window having a pivotal step or steps extending along an outer surface of the inner sash so that, after the inner sash has been moved or tilted relative to the frame, the step can be pivoted so that it does not interfere with the tilting or removal of the outer sash relative to the frame.

2. Description of the Prior Art

In window construction, where the sashes are not removable, it has been conventional to have a step to the exterior of the outer sash, a step to the exterior of the inner sash and a step to the interior of the inner sash. However, with modern windows, it is desirable to have both sashes tiltable relative to the frame and removable from the frame for cleaning or other purposes. Each of the sashes has releasable locking means used in combination with a window shoe or shoes so that each sash can in turn be tilted and/or removed from the frame. In this way, both sides of the glass in each of the sashes can be cleaned from an interior of the building where the window is installed.

In order to provide a window where both sashes can be readily removed from an interior of the building, previous windows have been designed with no steps whatsoever on the frame and flexible and resilient jambs that are under pressure towards each sash but are flexible enough to allow each sash to be removed from the frame by exerting sufficient force on the sash. Unfortunately, these windows are inefficient from the point of view of energy conservation and have been known to be quite drafty and generally unsatisfactory in cold climates. Furthermore, the performance of these types of windows worsens with age as the flexible and resilient jambs become more rigid and the pressure exerted onto the sash is reduced with time.

In another type of known window, there is a step to the exterior of the outer sash but no step immediately to the exterior of the inner sash or to the interior of the inner sash. The sashes can be easily removed from the frame in these types of windows but, unfortunately, the windows are drafty and can leak terribly in cold weather, particularly when subjected to windy weather conditions. Also, as the seal between the outer sash and frame is not protected from the elements, it can get wet and subsequently freeze, thereby causing serious damage to the sash and/or frame.

Still another type of known window has an inner sash that is slightly larger than an outer sash with a corresponding increase in the size of the frame adjacent to the outer sash as compared to the frame adjacent to the inner sash. This window has a disadvantage in that the two sashes are different in size and are therefore more expensive to manufacture and install within the frame.

Still another type of prior art window has a step to the exterior of the outer sash and a step to the interior of the inner sash with a depressable step immediately to the exterior of the inner sash. The depressable step is usually spring-loaded and can be depressed so that it is flush with an interior surface of the window frame in which it is mounted, thereby allowing the removal of the inner and outer sashes. The disadvantage of this type of window is that it is very difficult to hold the step in a depressed position along its entire length, while simultaneously operating the releasable locking means and removing the outer sash. Also, as the window ages the step can become impossible to depress. Another type of depressable step has an appropriately located notch located within it so that when the step is properly depressed with part of the frame resting against the notch, the step will remain in a depressed position until it is manually released. Unfortunately, this type of spring-loaded depressable step suffers from a disadvantage in that it can become released prematurely or will not lock in position at all as the window ages and the notch becomes worn. Both types of depressable steps are relatively expensive to manufacture when compared to the step of the present invention.

In summary, in previous windows where there is no step immediately to the exterior of the inner sash, the windows do not perform well when tested for heat loss capabilities as the seal or weather stripping on the sash is exposed to the ambient air. Further, previous windows having a depressable step located immediately to the exterior of the inner sash can also be unsatisfactory as the step is expensive to manufacture and can be difficult to operate or does not operate satisfactorily or at all.

SUMMARY OF THE INVENTION

It is an object of the present invention to provide a step immediately to the exterior of an inner sash that is simple and inexpensive to manufacture and install in a window frame and is durable and simple to operate.

A window in accordance with the present invention has an inner sash and an outer sash slidably mounted relative to one another in a frame. Each sash has releasable locking means so that each sash can be tilted relative to said frame or removed completely from said frame as desired for cleaning or other purposes the inner sash has a pivotal step extending along one length of an outer surface thereof, said step having a cane-shaped cross-section, with a curved portion of said cross-section seated in an arcuate channel in said frame. The step is pivotal through substantially ninety degrees so that when said outer sash has been tilted relative to said frame, said step can be rotated from a position parallel to said inner sash to a position perpendicular to said inner sash so that it will not interfere with said outer sash when it is tilted. The step is held in position parallel to said sashes when they are slidably mounted relative to one another within said frame.

Preferably, when the window is a double-hung window, there are two pivotal steps, one along each side of the outer surface of the inner sash.

Preferably, when the window is a horizontal slider window, the pivotal step is located along a top of the outer surface of the inner sash.

In a further embodiment, a window has an inner sash and an outer sash slidably mounted relative to one another in a frame. Each sash has a releasable locking means so that each sash can be tilted relative to said frame or removed completely from said frame as desired for cleaning or other purposes. The inner sash has a pivotal step extending along one length of an outer surface thereof. The step is made of flexible and resilient material and is pivotal through substantially ninety degrees so that when said outer sash has been tilted relative to said frame, part of said sash is rotated from a position parallel to said inner sash to a position perpendicular to said inner sash while another part of said step remains in a position parallel to said inner sash. The step is sufficiently resilient to return to a position parallel to said sashes when they are slidably mounted relative to one another within said frame.

In still a further embodiment, a window has an inner sash and an outer sash mounted in a frame with at least the inner sash being slidably mounted in said frame. At least the inner sash has releasable locking means so that the inner sash can be tilted relative to said frame or removed completely from said frame for cleaning or other purposes. The frame supports an exterior screen adjacent to the inner sash when the window is in a closed position. The screen is supported in a fixed vertical position that has releasable locking means so that the screen can be tilted relative to said frame or removed completely from said frame as desired for cleaning or other purposes. The inner sash has a pivotal step extending along one length of an outer surface thereof between said inner sash and said screen when the inner sash is in a closed position. The step does not move vertically within said frame, said step being pivoted through substantially ninety degrees so that it will not interfere with said screen when said screen is tilted inward.

DESCRIPTION OF A PREFERRED EMBODIMENT

Figure 1:
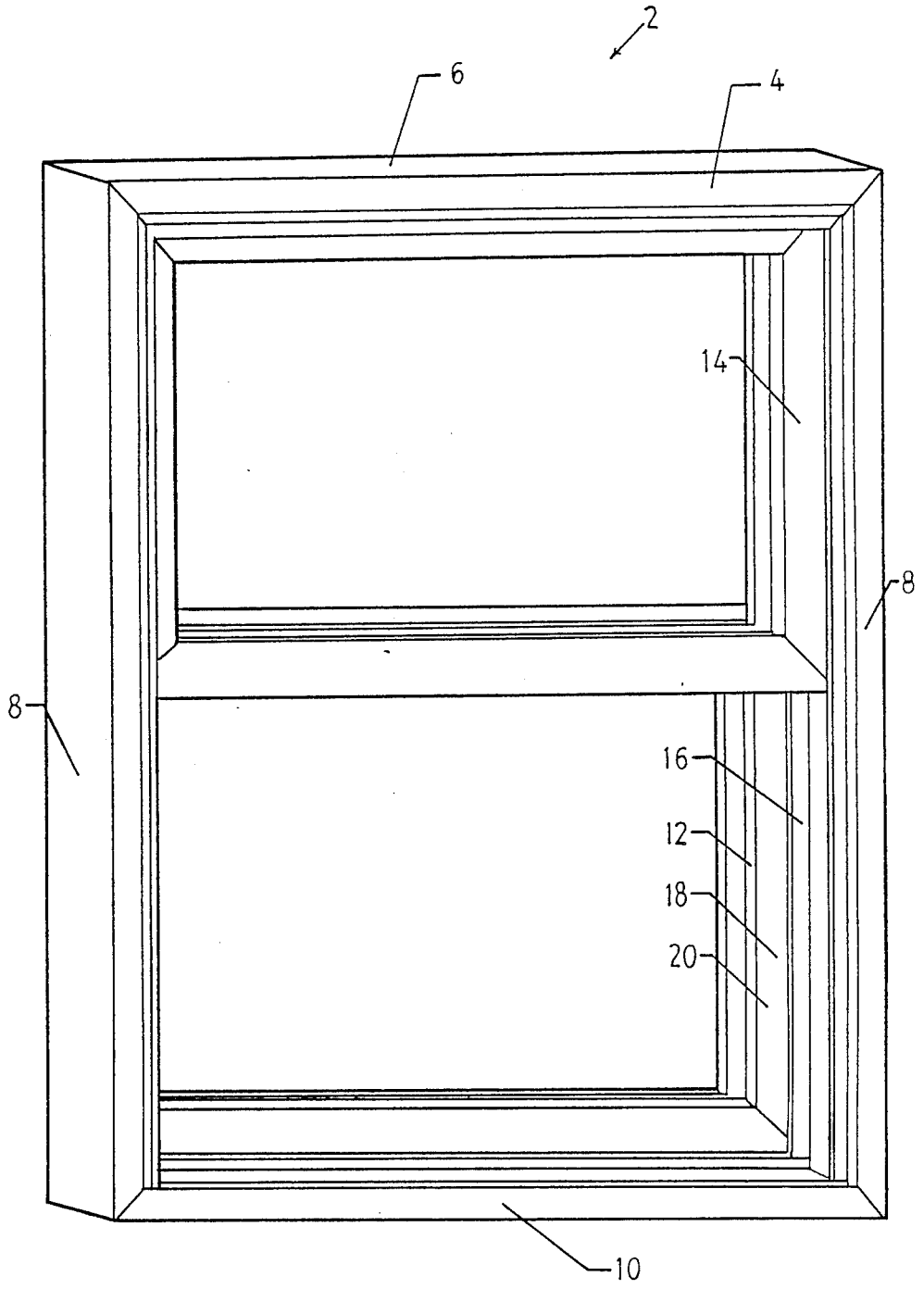
FIG. 1 is a perspective view of an exterior of a double-hung window.

Referring to FIG. 1 in greater detail, a double-hung window 2 has a frame 4 having a head 6, two jambs 8 and a sill 10. An inner sash 12 and an outer sash 14 are slidably mounted relative to one another in the frame 4. A pivotal step 16 extends along each side 18 of an outer surface 20 of the inner sash 12. In FIG. 1, the pivotal step 16 on the left-hand side of the window 2 cannot be seen as it is hidden by the jamb 8 of the frame 4.

Figure 2:
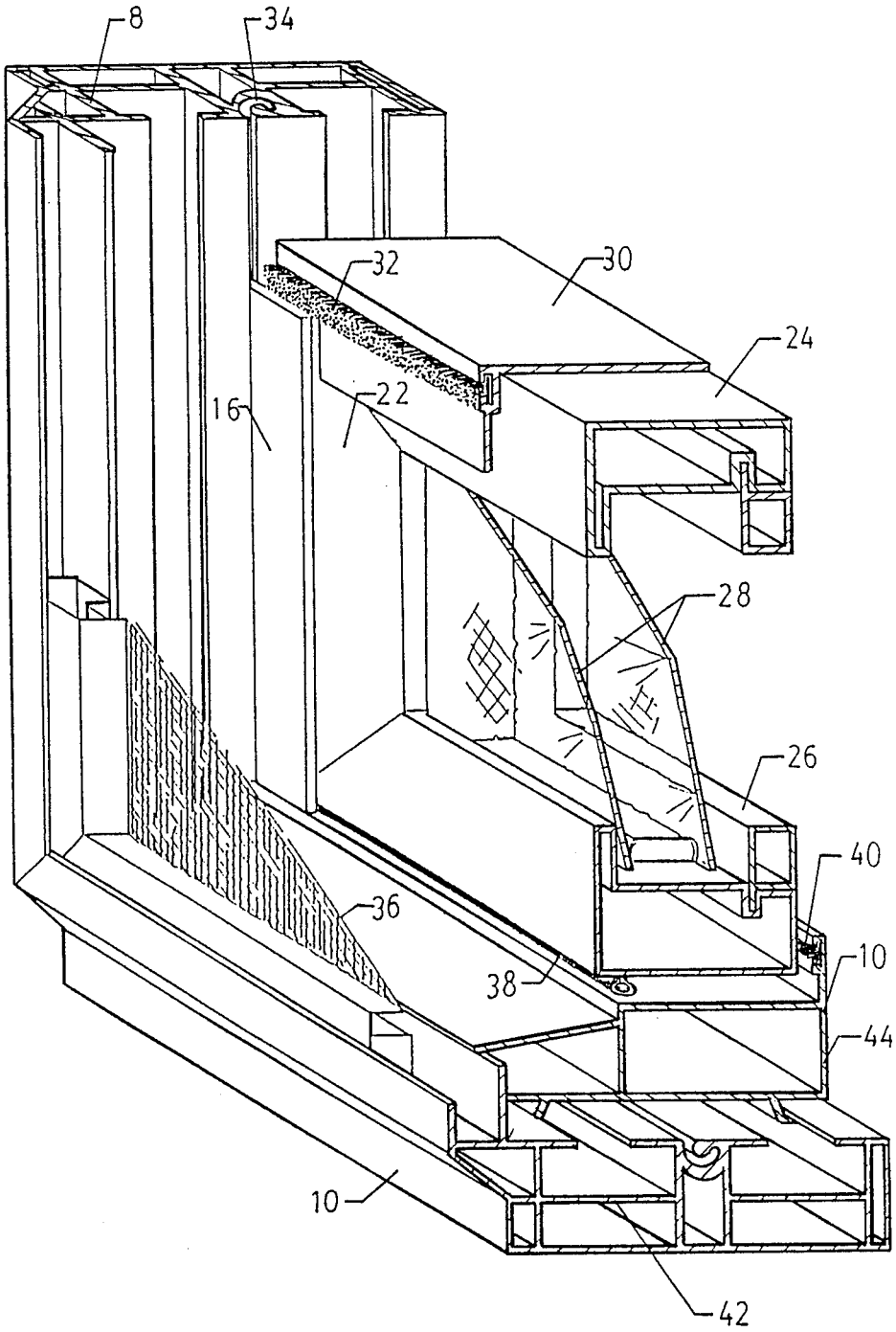
FIG. 2 is a partial cut-away perspective view of an inner sash and a pivotal step in a frame.

Referring to FIG. 2 in greater detail, the partial inner sash 12 is mounted adjacent to a jamb 8 of the frame 4. The sash 12 has a style 22 along each side 18 (only one of which is shown) and rails 24, 26 at a top and bottom of the sash 12 respectively. The styles 22 and rails 24, 26 enclose panes of glass 28. On top of the rail 24 there is located an interlock 30. The interlock 30 has weatherstripping 32 along an inner edge to seal the line of contact between the sashes 12, 14, when they are both in a closed position. The outer sash 14 is not shown in FIG. 2.

There are two pivotal steps 16 (only one of which is shown in FIG. 2), one along each side 18 of the outer surface 20 of the inner sash 12 when the inner sash is in a closed position. The pivotal step 16 extends along one length of each side of the sash 12, from the sill 10 to, but not penetrating, the weather strip 32 of the interlock 30. It can be seen that the pivotal step 16 is located in a channel 34 having an arcuate cross-section.

It can be seen that the window 2 has a screen 36 mounted on a front thereof. It can also be seen that there is weatherstripping 38 between a bottom of the inner sash 12 and the sill 10. In addition, there is a length of weatherstripping 40 along an interior surface of a bottom rail 26 of the inner sash 12. Further with respect to FIG. 2, it can be seen that the jamb 8 has an identical cross-section to a base 40 of the sill 10. While this is not essential for the purposes of the present invention, it results in great cost savings to use as many interchangeable components as possible in the construction of the window 2. The jamb 8 is completely interchangeable with the base 42. An upper portion 44 of the sill 10 is designed to snap into place on the base 42. Also, the sashes 12, 14 are identical to one another.

Figure 3:
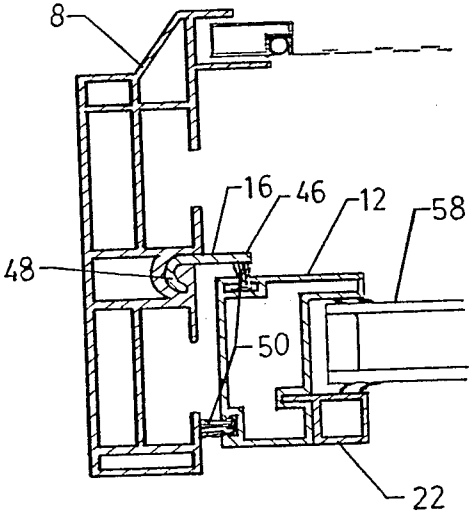
FIG. 3 is a partial sectional view of an inner sash in a frame with a pivotal step in an operating position.

In FIG. 3, there is shown a cross-sectional view of one jamb 8 and a partial cross-sectional view of the inner sash 12 and pivotal step 16. It can be seen that the step 16 has a cane-shaped cross-section with a straight portion 46 and a curved portion 48. The straight portion is parallel to the sash 12 and perpendicular to the jamb 8 when the step 16 is in an operating position as shown in FIG. 3. The inner sash 12 has weatherstripping 50 at two locations on the style 22, one weatherstripping 50 extending from the style 22 to the step 16 and the other weatherstripping 50 extending from the style 22 to the jamb 8. Thus, it can be seen that for ambient air to pass through the window 2, it must pass through the both sets of weatherstripping 50. Also, the weatherstripping 50 is protected from direct blasts of wind or rain by the step 16. Further, the curved portion 48 of the step 16 preferably fits snugly within the channel 34 to provide an air-tight seal between the step 16 and the frame 4.

Figure 4:
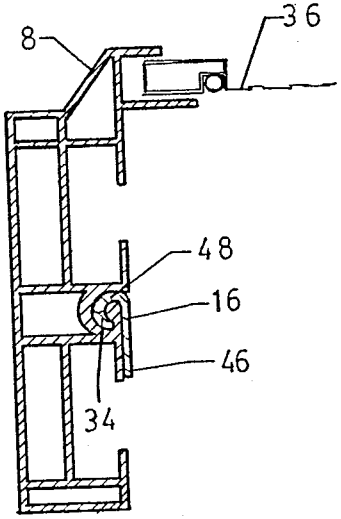
FIG. 4 is a partial sectional view of the frame of FIG. 3 with the inner sash removed and the pivotal step rotated to a down position.

In FIG. 4, the inner sash has been removed and the pivotal step 16 has been rotated inward from the operating position of FIG. 3 to the down position so that the straight portion is in contact with a surface of the jamb 8. In the down position, the straight portion of the step 16 is parallel to the jamb 8 and perpendicular to the position of the sashes 12, 14 [(neither of which is shown in FIG. 4) if they were properly located within the frame 4.

Figure 5:
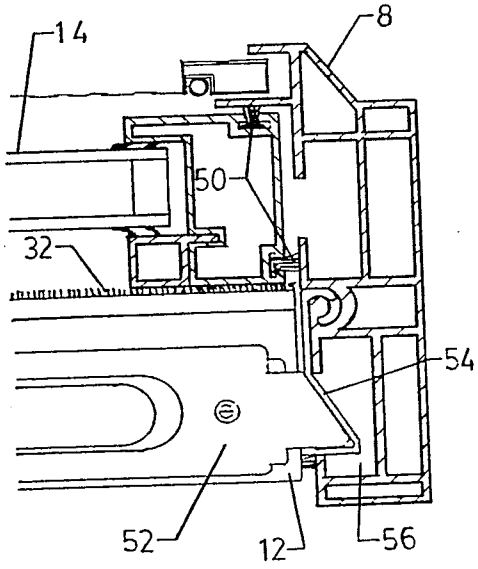
FIG. 5 is a partial sectional view of an upper portion of the frame showing an outer sash and a cover for an inner jamb.

In FIG. 5, there is shown a partial sectional view of an upper portion of the jamb 8 with the outer sash 14.

One pivotal step 16 extends vertically along the lower portion of each jamb 8 but not along the upper portion. A releasable lock 52 is located on top of the inner sash 12. A jamb cover 54 extends from the arcuate channel 34 to cover an opening 56 of the jamb 8. The jamb cover 54 also extends vertically along the opening 56 of the jamb 8 from the interlock 30 to the head 6. The main purpose of the cover 54 is to improve the interior appearance of the window 2. However, the cover 54 also serves a functional purpose in that it is shaped to receive the releasable lock 52. The lock 52 is slidable vertically within the cover 54. When it is desired to remove the inner sash or to tilt it inward for cleaning purposes, the lock 52 can be disengaged from the cover 54. The cover 54 is optional and is simply an additional but unnecessary feature of the invention. Further, the cover 54 prevents the pivotal step 16 from rising upward within the channel 34. There is one cover 54 along the upper portion of each of the jambs 8.

It can be seen that the outer sash 14 has weatherstripping 50 located in a position similar to the weatherstripping 50 of the inner sash 12. From FIGS. 1 to 5, it should be noted that the window 2 is advantageously designed so that the two sashes 12, 14 are identical to one another.

Figure 6:
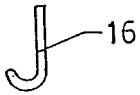
FIG. 6 is a sectional view of a cane-shaped pivotal step.

In FIG. 6, there is shown a cross-sectional view of the pivotal step 16 having a straight portion 46 and a curved portion 48. As can readily be seen, the step 16 has a cane-shaped cross-section.

In operation, both sashes 12, 14 can be easily and replaceably removed from the frame 4 or simply tilted in the frame 4. While only one releasable lock 52 is shown in FIG. 5, there are two locks on each of the sashes 12, 14. The locks 52 are located on each side at a top of each sash. The locks are not described in detail as the locks are conventional and there are many different types of locks readily available on the market. Also, each sash has two window shoes (not shown in the drawings). There is one window shoe located on either side of said sash near the bottom rail 26. The window shoes are conventional and these are also readily available on the market. For this reason, neither the window shoes nor the locks 52 are further described with respect to this invention. If desired, the sashes can be tilted inward relative to the frame 4 rather than be completely removed from the frame.

When it is desired to remove one or both of the sashes from the frame 4, one first partially opens the inner sash 12. Next, the two locks 52 are released and an upper portion of the sash 12 is tilted inward. The window shoes, though not shown, are designed to brake the sash 12 relative to the jamb 8 when the sash is tilted so that the sash 12 will no longer readily slide relative to the jamb 8. Once the inner sash has been tilted, if desired, additional force can be applied to the window shoes to rotate the sash by moving the window shoes in opposite directions relative to one another until the window shoes move out of contact with the jamb 8. Then, the sash can be completely removed. Alternatively, when the sash is tilted inward, an exterior surface 58 of the panes 28 of glass can be cleaned.

Once the inner sash is completely removed from the frame 4 or at least tilted inward sufficiently so that it is moved out of the way, the pivotal step 16 on each side of the window 2 can be moved from the position shown in FIG. 3 to the position shown in FIG. 4. In other words, the pivotal step 16 can be rotated inward so that the straight portion 46 lies against an interior surface of the jamb 8. Next, the outer sash 14 can be lowered slightly so that it is partially opened and the locks 52 on the outer sash 14 can be released. The sash 14 can then be tilted inward and the outer surface 58 of the panes of glass 28 can be cleaned. If desired, the outer sash 14 can be completely removed from the frame 4 in the manner already described for the inner sash 12.

When it is desired to move the sashes from a tilted position to an operable position within the frame 4 or to reinsert the sashes 12, 14 within the frame 4, the opposite procedure can be followed. Briefly, the outer sash 14 is inserted into position first, then the pivotal step 16 is moved from the down position to the operable position, that is, from the position shown in FIG. 4 to the position shown in FIG. 3. Finally, the inner sash 12 is inserted into the frame 14 and moved to the position shown in FIG. 1.

Figure 7:
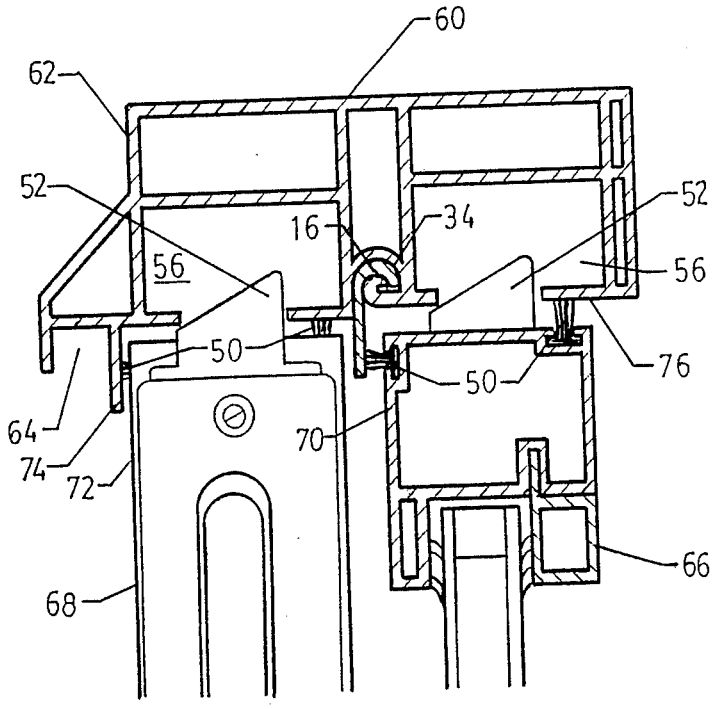
FIG. 7 is a partial perspective view of a horizontal slider window having a pivotal step in an operating position along a top of an exterior surface of an inner sash.

In FIG. 7, there is shown a partial sectional view of a horizontal slider window having a top rail 60 of a frame 62, the rail 60 has an arc-shaped channel 34 with a pivotal step 16 located therein The step 16 has a cane-shaped cross-section. On an exterior side of the rail 60 there is a groove 64 for receiving a screen (not shown). Within the frame 62 there is mounted an inner sash 66 and an outer sash 68. These sashes 66, 68 each have locking means 52 extending into channels 56 of the top rail 60. The inner sash 66 has weatherstrips 50, one weatherstrip 50 extending between the sash 66 and the rail 60 and the other weatherstrip 60 extending between an exterior surface 70 of the inner sash 66 and the step 16.

The outer sash 68 also has two weatherstrips 50, one extending between the sash 68 and the rail 60 and the other weatherstrip 50 extending between an exterior surface 72 of the outer sash 68 and an immovable outer step 74. There are numerous other weatherstrips 50 located on the sashes 66, 68 that are not shown in FIG. 7. However, these additional weatherstrips 50 are conventional and are not further described.

The horizontal slider window shown in FIG. 7 operates in a manner similar to the double-hung window shown in the remaining figures. When it is desired to remove the sashes 66, 68 from the frame 62, the inner sash 66 is partially opened, the locking means 52 of the inner sash 66 is disengaged from the channel 56 and the inner sash 66 can then be tilted inward and, if desired, removed entirely from the frame 62 in the same manner as previously described for the double-hung window 2 of FIG. 1.

After the inner sash 66 has been tilted inward or removed from the frame 62, the pivotal step 16 is rotated from the operating position shown in FIG. 7 to the down position, similar to that shown in FIG. 4. In the down position, not shown for the horizontal slider window, a straight portion of the step 16 is parallel to an interior surface 76 of the top rail 60. Next, the outer sash 68 is partially opened and the locking means 52 of the outer sash 68 is released from the channel 56. The outer sash can then be tilted inward and, if desired, removed entirely from the frame 62. When it is desired to reinsert the sashes 66, 68 into the frame 62 of the horizontal slider window, the opposite procedure is followed. As this procedure has been outlined in some detail for the double-hung window, it will not be further discussed for the horizontal slider window.

The pivotal step 16 of the horizontal slider window preferably extends only along an exterior surface 70 of the inner sash 68. However, if desired, the step 16 can extend across an entire width of the horizontal slider window.

Figure 8:
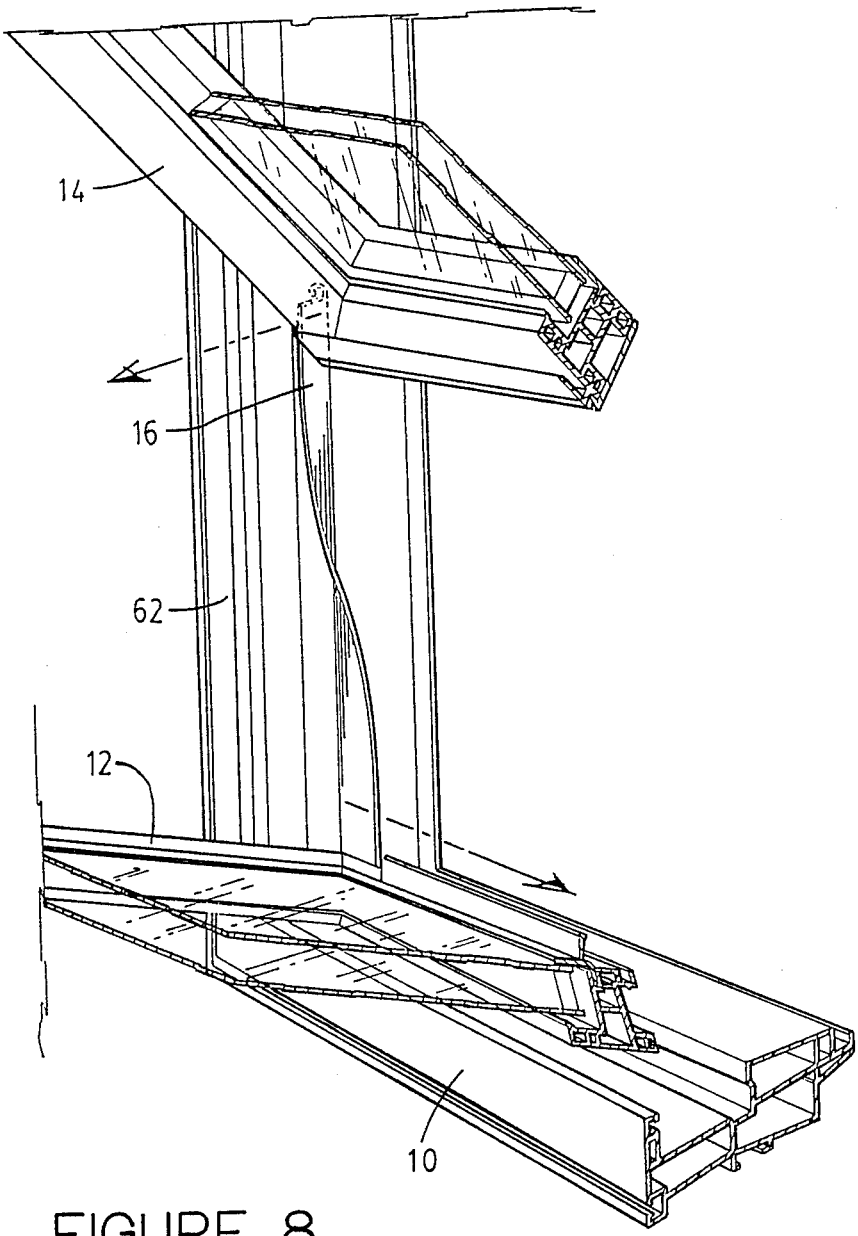
FIG. 8 is a partial perspective view of a window having a flexible and resilient pivotal step.

A further embodiment of the invention is shown in FIG. 8 where the pivotal step 16 is made of a flexible and resilient material so that when the inner sash 12 is tilted out of the way, the outer sash 14 can be tilted inward without manually pivoting the pivotal step 16 as just described. Even though the inner sash 12 has not been tilted far enough to allow the lower portion of the step 16 to pivot, the inward tilting of the outer sash 14 automatically causes the upper portion of the pivotal step 16 to pivot inward. Thus, the step 16 is twisted as shown in FIG. 8. The step on the opposite side of the double hung window 2 (not shown in FIG. 8), will function in the same manner. Further, when the outer sash 14 is tilted outward back to its initial vertical position within the frame 4, the resilience of the step 16 will cause it to return substantially to its original untwisted position as shown in FIG. 2. Thus, there is no need to manually pivot the step back to the position shown in FIG. 2. If the step is still somewhat twisted after the outer sash 14 has been returned to its initial position, the return of the lower sash 12 to its initial vertical position will cause the pivotal step to return the rest of the way to the position shown in FIG. 2.

Figure 9:
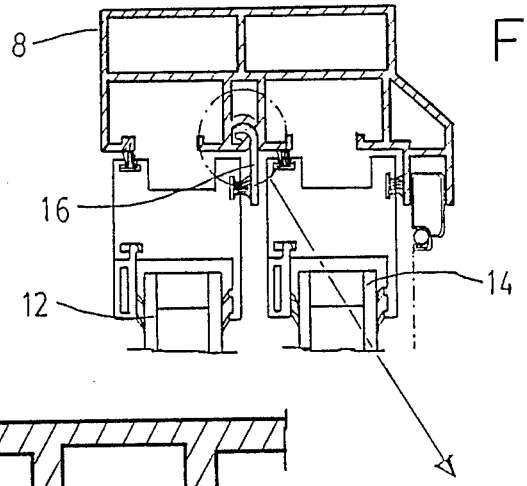
FIG. 9 is a partial sectional view of a pivotal step installed between jambs of identical size.
Figure 10:
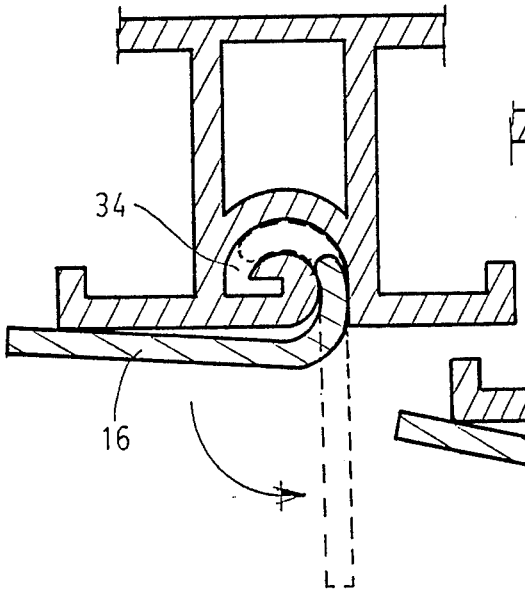
FIG. 10 is an enlarged partial sectional view of a step about to be laterally inserted in a channel.
Figure 11:
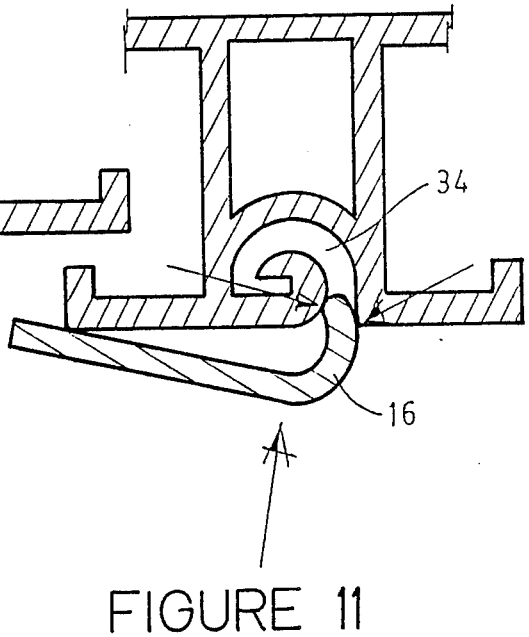
FIG. 11 is an enlarged partial sectional view of a step partially inserted laterally into a channel.

As shown in FIGS. 9, 10 and 11, the pivotal step 16 of the present invention has a further advantage in that it is sufficiently flexible and resilient relative to the channel 34 that it can be laterally forced into or out of said channel. This has an advantage during the manufacture of the window 2 in that the pivotal steps 16 can be inserted into the corresponding channels 34 either longitudinally or laterally. After the window is installed, if the pivotal step 16 becomes damaged in any way and is required to be replaced, the step cannot be removed longitudinally from the channel 34 without completely removing the entire window from the opening in which it is installed and dismantling either the sill or the interlock from the rest of the frame. It is thus important that the pivotal step can be removed laterally from the channel 34 and laterally replaced with a new pivotal step without dismantling the window frame or removing it from the opening in which it is installed.

Figure 12:
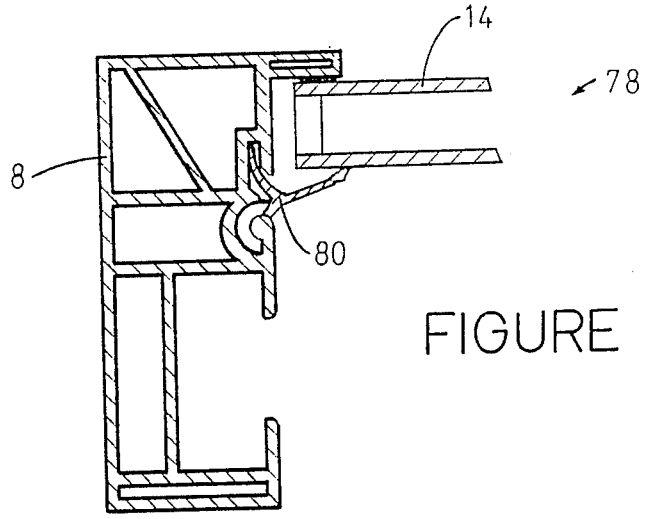
FIG. 12 is a partial sectional view of an upper outer sash of a single hung window.
Figure 13:
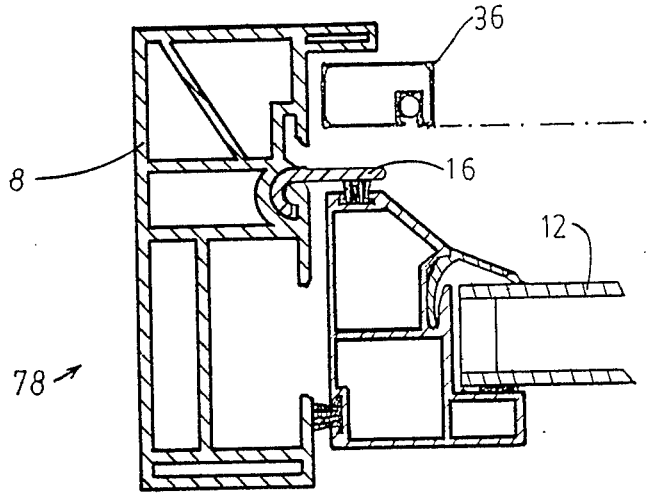
FIG. 13 is a partial sectional view of a lower inner sash of the single hung window of FIG. 12.

In FIGS. 12 and 13, there is shown a partial sectional view of an upper outer sash 14 and a lower inner sash 12 respectively of a single-hung window 78. The outer sash 14 is held in place by an elongated three-sided support 80, said support 80 being partially anchored in the channel 34. The outer sash 14 is in a fixed position as the window is a single-hung window.

The inner sash 12 is slidable vertically relative to the jamb 8. The screen 36 is located outside of the inner sash 12 and is supported in the jamb 8 beneath the outer sash 14. Both the inner sash 12 and the screen 36 has releasable locking means located thereon so that they can both be tilted relative to the jamb 8. Located between the inner sash 12 and the screen 36 is the cane-shaped pivotal step 16 mounted in the channel 34. The step 16 extends along the full length of the inner sash 12 when that sash is in a closed position. In a single-hung window, there is another pivotal step and jamb for the other side of the window that is a mirror image of the arrangement shown in FIGS. 12 and 13. The pivotal step 16 functions in the same manner in a single-hung window as it does for a double-hung window except that the outer sash 14 remains in a fixed position and does not tilt relative to the jamb 8. It is the screen 36 that tilts relative to the jamb 8. When it is desired to clean the single-hung window 78, the inner sash 12 can be tilted inward. This permits the pivotal step to be rotated inward manually or, when the step is flexible and resilient to twist as shown in FIG. 8. This allows the screen 36 to be tilted inward and removed from the frame so that an outer surface of the outer sash 14 can be cleaned by reaching through the opening left by the removal or inward tilting of the inner sash 12 and the screen 36.

Numerous variations in the pivotal step of the present invention will be readily apparent to those skilled in the art. For example, the step could be extended through the interlock of the window 2 along the full length of the two sashes. While the step has been specifically described for a double-hung window and a horizontal slider window the step would be utilized in a virtually identical manner in a single-hung window. It is important, though not essential, for the efficient use of windows having a pivotal step that the connection between the step and the frame be air tight.

The pivotal step of the present invention has numerous advantages in that it provides a solid seal against direct blasts of wind or rain. Also, even if water were to leak into the arcuate channel 34, it would be unlikely to get behind the step 16. Preferably, the channel 34 is designed to be the same size or slightly smaller than a curved portion of the step 16 so that the step 16 fits snugly within the channel 34. When the step is moved from the operating position to the down position or vice-versa, it can be moved easily and remains in position without being manually held in that position. This is particularly important for the step of the horizontal slider window as gravity will pull the step from the down position to the operating position if the step fits loosely in the channel 34. An operator will thus encounter increased difficulty when reinstalling the outer sash.

Therefore, when an operator is removing the sashes from a window of the present invention, the operator has both hands free to handle the sash and does not need to worry about any movement of the step. Further, no springs are used with the step 16. This not only saves a great deal of expense in manufacturing costs but it also means that the step 16 will not move under its own power. Also, the elimination of any spring means greatly extends the operating life of the step 16.

What I claim as my invention is:

1. A window comprising an inner sash and an outer sash slidably mounted relative to one another in a frame, each sash having releasable locking means so that each sash can be tilted relative to said frame or removed completely from said frame as desired for cleaning or other purposes, the inner sash having a pivotal step extending along one length of an outer surface thereof, said step having a cane-shaped cross-section with a curved portion of said cross-section seated in an arcuate channel in said frame, said step being pivotal through substantially ninety degrees so that when said outer sash has been tilted relative to said frame, said step can be rotated from a position parallel to said inner sash to a position perpendicular to said inner sash so that it will not interfere with said outer sash when it is tilted, said step being held in position parallel to said sashes when they are slidably mounted relative to one another within said frame.

2. A window as claimed in claim 1 wherein the pivotal step is made of flexible and resilient material and the curved portion is sized relative to the arcuate channel so that it can be laterally inserted into said channel or laterally removed from said channel, as desired.

3. A window as claimed in claim 2 wherein the step is sufficiently flexible and resilient so that it can be twisted by the tilting of the sashes with one part of the step perpendicular to the sashes while another part is parallel to the sashes, the step being resilient enough to return to an untwisted position parallel to the sashes when the sashes are returned to a vertical position.

4. A window as claimed in claim 1 wherein the window is a double-hung window and there are two pivotal steps, one along each side of the outer surface of the inner sash.

5. A window as claimed in claim 1 wherein the window is a horizontal slider window and the pivotal step is located along a top of the inner sash.

6. A window as claimed in any one of claims 1, 2 or 3 wherein the pivotal step rotates towards an interior side of said frame when said inner sash has been tilted relative to said frame or removed completely so that it does not interfere with the rotation of said step.

7. A window as claimed in any one of claims 1, 2 or 3 wherein the step extends along the inner sash and the outer sash.

8. A window as claimed in any one of claims 1, 2 or 3 wherein the pivotal step extends only along a length of the inner sash to, but not penetrating, an interlock between the two sashes.

9. A window as claimed in any one of claims 1, 2 or 3 wherein in an operating position, the pivotal step is parallel to the sash and perpendicular to the frame and in a down position, the step is perpendicular to the sash and parallel to the frame, a straight portion of said cane-shaped step being in contact with said frame.

10. A window as claimed in any one of claims 1, 2 or 3 wherein the pivotal step has a cane-shaped cross-section, with a curved portion of said cross-section seated in an arcuate channel in said frame, said pivotal step extending only along a length of the inner sash to, but not penetrating an interlock, that portion of a jamb of the frame beyond the interlock being closed by a cover.

11. A window as claimed in any one of claims 1, 2 or 3 wherein the pivotal step has a cane-shaped cross-section, with a curved portion of said cross-section snugly seated in an arcuate channel in said frame so that a connection between the step and said frame is substantially air tight.

12. A window as claimed in any one of claims 1, 2 or 3 wherein a connection between the step and the frame is substantially air tight.

13. A window as claimed in any one of claims 1, 2 or 3 wherein the step remains in a down position without being manually held in that position.

14. A window comprising an inner sash and an outer sash slidably mounted relative to one another in a frame, each sash having releasable locking means so that each sash can be tilted relative to said frame or removed completely from said frame as desired for cleaning or other purposes, the inner sash having a pivotal step extending along one length of an outer surface thereof, said step being made of flexible and resilient material, said step being pivotal to substantially ninety degrees so that when said outer sash has been tilted relative to said frame part of said step can be rotated from a position parallel to said inner sash to a position perpendicular to said inner sash, while another part of said step remains in a position parallel to said inner sash, said step thus being twisted automatically by said outer sash when it is tilted, said step being resilient enough to return to a position parallel to said sashes when the sashes are slidably mounted relative to one another within said frame.

15. A window comprising an inner sash and an outer sash mounted in a frame, at least the inner sash being slidably mounted in said frame, at least the inner sash having releasable locking means so that the inner sash can be tilted relative to said frame or removed completely from said frame for cleaning or other purposes, the frame supporting an exterior screen adjacent to the inner sash when the window is in a closed position, said screen being supported in a fixed vertical position but having releasable locking means so that the screen can be tilted relative to said frame or removed completely from said frame as desired for cleaning or other purposes, the inner sash having a pivotal step extending along one length of an outer surface thereof between said inner sash and said screen when the inner sash is in a closed position, said step not moving vertically within said frame, said step being pivoted through substantially ninety degrees so that it will not interfere with said screen when said screen is tilted inward.

16. A window as claimed in claim 15 wherein the step is sufficiently flexible and resilient so that it can be twisted by the tilting of the screen with one part of the step perpendicular to the sashes while the other part is parallel to the sashes, the step being resilient enough to return to an untwisted position parallel to the sashes when the inner sash and screen are returned to a vertical position.

17. A window as claimed in claim 15 wherein the window is a single-hung window and there are two pivotal steps, one along each side of the outer surface of the inner sash.

18. A window as claimed in claim 15 wherein the window is a double-hung window and the outer sash is slidably mounted within said frame and has a releasable locking means so that it can be tilted relative to said frame or removed completely from said frame for cleaning or other purposes, said window having two pivotal steps, one along each side of the outer surface of the inner sash.

19. A window as claimed in any one of claims 15, 16 or 18 wherein the step has a cane-shaped cross-section, with a curved portion of said cross-section seated in an arcuate channel in said frame.

* * * * *